US005328355A

United States Patent [19]

Kobayashi et al.

[11] Patent Number: 5,328,355

[45] Date of Patent: Jul. 12, 1994

[54] COMBUSTOR AND COMBUSTION APPARATUS

[75] Inventors: Hironobu Kobayashi, Katsuta; Shigeru Azuhata, Hitachi; Masayuki Taniguchi, Katsuta; Tadayoshi Murakami, Hitachi; Kiyoshi Narato, Ibaraki; Michio Kuroda; Satoshi Tsukahara, both of Hitachi, all of Japan

[73] Assignee: Hitachi, Ltd., Tokyo, Japan

[21] Appl. No.: 765,835

[22] Filed: Sep. 26, 1991

[30] Foreign Application Priority Data

Sep. 26, 1991 [JP] Japan ..... 2-256404

[51] Int. Cl.[5] ..... F23D 23/00; F23D 11/40; F23D 11/44

[52] U.S. Cl. ..... 431/10; 431/9; 431/11; 431/12; 431/187; 431/350; 60/738; 60/743; 60/747

[58] Field of Search ..... 431/8, 9, 10, 11, 12, 431/166, 167, 171, 181, 183, 182, 187, 350, 354, 347; 60/736, 737, 738, 726, 743, 749, 750, 747

[56] References Cited

U.S. PATENT DOCUMENTS

| | | | |
|---|---|---|---|
| 1,876,168 | 9/1932 | Richardson . | |
| 2,941,362 | 6/1960 | Bailey | 60/749 |
| 3,194,215 | 7/1965 | Barnes | 431/167 X |
| 3,530,667 | 9/1970 | Bryan | 60/743 |
| 3,834,159 | 9/1974 | Vdoviak | 239/403 X |
| 3,851,466 | 12/1974 | Verdouw | 60/749 X |
| 3,912,164 | 10/1975 | Lefebvre et al. | 60/743 X |
| 3,977,427 | 8/1976 | Reed et al. . | |
| 4,092,826 | 6/1978 | Pask | 60/743 |
| 4,222,243 | 9/1980 | Mobsby | 60/743 X |
| 4,323,043 | 4/1982 | Alderson . | |
| 4,356,698 | 11/1982 | Chamberlain | 60/743 X |
| 4,399,107 | 8/1983 | Bose . | |
| 5,020,329 | 6/1991 | Ekstedt et al. | 60/743 X |
| 5,094,610 | 3/1992 | Mandai et al. | 431/183 |

FOREIGN PATENT DOCUMENTS

| | | | |
|---|---|---|---|
| 11061 | of 1927 | Australia | 431/183 |
| 3125319A1 | 6/1981 | Fed. Rep. of Germany . | |
| 14325/80 | 4/1980 | Japan . | |
| 62-35016 | 7/1987 | Japan . | |
| 0259331 | 10/1990 | Japan | 60/737 |
| 2003552 | 3/1979 | United Kingdom . | |
| 2172099 | 9/1986 | United Kingdom . | |

OTHER PUBLICATIONS

EP-A-0233971 (NTG Nukleartechnix GmbH) Ortmayer, Feb. 9, 1987.

Patent Abstracts of Japan, vol. 13, No. 314(M-827) May 18, 1989, and JP-A-01 033 421 (Ishikawajima Harima Heavy Ind Co Ltd.)

Airblast Atomization, A. Lefebvre, Prog. Energy Combust. Sci. vol. 6, pp. 233-261.

Gas Turbine Academic Society Journal, vol. 16, No. 64, pp. 47-55.

*Primary Examiner*—Carl D. Price

*Attorney, Agent, or Firm*—Antonelli, Terry, Stout & Kraus

[57] ABSTRACT

In a combustor including a premixing type combustion burner which has an atomizer for ejecting a liquid fuel together with combustion air to atomize the liquid fuel, the atomizer is comprised of an inner shell to an inner peripheral surface of which the liquid fuel is supplied, an outer shell defining a passage for the combustion air running substantially straightly between the outer shell itself and an outer peripheral surface of the inner shell, and a swirling-flow guide plate for swirling the combustion air passed into the inner shell, while directing it in a downstream direction. The combustor further includes a resistor abruptly decreased in sectional area downstream and provided substantially downstream of the center of the swirling flow and in the vicinity of an outlet of the premixing type combustion burner for providing a resistance to a premixture ejected from the premixing type combustion burner.

13 Claims, 8 Drawing Sheets

COMBUSTOR AND COMBUSTION APPARATUS

BACKGROUND OF THE INVENTION

1. Field of the Invention

The present invention relates to a combustor in which a liquid fuel is preevaporated, premixed with a combustion air and burned, and to a combustion apparatus comprising the combustor and a combusting process.

2. Description of the Related Art

In order to increase the loading of a gas turbine combustor, there has been a recent tendency to use a preevaporated/premixed type combustion wherein a liquid fuel is vaporized (preevaporated) and premixed with air, and the resulting premixture (premixed gas) is ejected from the same nozzle. The use of such preevaporated/premixed combustion is advantageous in the following two respects. One is that the use of the pre-evaporating and pre-mixing type combustion enables the reaction region for combustion to be reduced in size. In other words, the flame can be shortened to enable a high load combustion. The other advantage is that the amount of NOx discharged can be reduced by employing a dilute fuel mixture in the combustion process.

Another type of combustion different from the premixing type combustion includes a diffusion combustion wherein air and a fuel are ejected from different nozzles. In diffusion combustion, a region in which the ratio of a theoretical air amount to an actual air amount in a fuel-air mixture (which will be referred to as an air ratio) is of about 1:1 is of always present in the course of the premixing of a fuel with air in a combustion chamber, even if combustion is conducted under a dilute-fuel condition. The temperature of a flame is higher in the vicinity of the region with an air ratio of about 1:1 and for this reason, a reduction in the amount of NOx is generally difficult.

On the other hand, in a premixing type combustion of a higher air ratio, i.e., in a premixing type combustion wherein an excess amount of air and a fuel are premixed and the resulting mixture is burned, the fuel-air mixture is burned under such a combustion condition that the fuel is dilute in the entire combustion region and hence, a reduction in the amount of NOx is easy. Such a dilute premixing combustion process is being increasingly used in a combustor for a gas turbine (for example, see Japanese Patent Publication No. 35016/87).

In general, to realize a premixing combustion using a liquid fuel, a premixing type combustion burner is provided which includes an atomizer for atomizing the liquid fuel, and an evaporation chamber in which the atomized liquid fuel is evaporated (see Gas Turbine Academic Society Journal, Vol 16, No. 64, PP 47 to 55).

In such a premixing type combustion burner, there are requirements for the formation of finely-divided atomized particles intended to hasten the evaporation of the fuel, and a formation of a uniform preevaporated-fuel/air premixture resulting from the mixing of the atomized particles with air.

An example of a premixing type burner which is at least capable of the formation of finely-divided atomized particles among the requirements included for a premixing type burner, is shown in FIG. 10 (see Prog. Energy Combust. Sci., No. 6, pp 233 to 261).

This premixing type burner comprises an inner cylinder. A liquid fuel is supplied to an inner peripheral surface of the inner cylinder. A pintle 5 is mounted within the inner cylinder 2. The diameter of the pintle is increased in diameter in a downstream direction. A prefilming surface 3 is formed around an inner periphery of the inner cylinder at its downstream side and gradually increased in diameter in the downstream direction.

Air running straightly through the inner cylinder 2 serves to form the liquid fuel into a film-like configuration to guide it to an atomizing lip 4. The film-like liquid fuel which has reached the atomizing lip 4 is ejected from the atomizing lip 4 toward an outer periphery by the air passed through the inner cylinder 2, and is sheared and finely divided by the air running straightly along the outside of the inner cylinder 2.

The finely dividing capability and the spray dispersing property are dependent upon the shape of the pintle 5. This is because the angle of ejection of the liquid fuel with respect to the air running straightly along the outside of the inner cylinder 2 is determined by the shape of the pintle 5.

Preheating of Liquid Fuel

The air is adiabatically compressed by a compressor and heated to a temperature of about 270° to 350° C. In the evaporation chamber, the finely divided atomized particles are heated by a combustion air and evaporated. In this case, it is necessary to prevent self-ignition of the atomized particles. Therefore, it is required that the residence time for the atomized particles in the evaporation chamber is equal to or less than the self-ignition time, and generally, it is preferable that the residence time in the evaporation chamber under a practical condition is equal to or less than about 4 m sec.

However, if the residence time for the atomized particles is merely within the self-ignition time, the atomized particles are supplied without being evaporated, resulting in a failure to provide a reduction in the amount of NOx.

Thereupon, in order to evaporate the atomized particles in the residence time which is within the self-ignition time, it is important to reduce the size of the atomized particles. However, there is a limit to the reduction in size of the atomized particles. Such a limit is of a value resulting from the division of a sum of volumes of the atomized particles by a sum of surface areas of the atomized particles, namely, about 40 um in so-called Zauta average particle size. Therefore, in order to hasten the evaporation of the atomized particles, it is necessary to promote the evaporation of the atomized particle by a further method, in addition to the fine division of the atomized particles.

An example of such a further method which can be conceived is a method for preheating the liquid fuel.

The preheating of the liquid fuel is commonly used in a heavy oil-fired boiler. In this boiler, however, a lower grade heavy oil solidified at ambient temperature is heated to about 80° C. for fluidification, thereby enabling transportation by piping. Consequently, the preheating of the liquid fuel in the heavy oil fired boiler would not promote the evaporation of the atomized particles.

The preheating for promoting the evaporation of the atomized particles is described, for example, in Japanese Patent Publication No. 14325/80. This method is to preheat the liquid fuel to a temperature equal to or more than the boiling point in an ejection atmosphere and then eject the preheated liquid fuel from a small hole into the evaporation chamber.

The fuel ejected from the small hole produces a so-called vacuum boiling phenomenon in the ejection atmosphere, and is finely divided and evaporated due to a volume expansion at this time.

Treatment of Combustion Intermediate Product

Presently, among combustion exhaust substances from a gas turbine, NOx and CO are subjects of control as environmental pollution materials, and a combustor and a denitration device suitable for satisfying the emission standards for NOx and CO should be provided. However, a combustion intermediate product such as aldehyde is not subject to control, and the present situation is that the aldehyde is scarcely treated.

An atomizer as described above is utilized for a combustor for a gas turbine in which combustion is conducted using a large amount of air, because the atomizer finely divides liquid fuel with a small loss in pressure.

To supply the atomized particles into a narrow space such as an evaporation chamber, however, it is necessary to mix the finely divided particles atomized at a small atomizing angle with air to supply the resulting mixture. In order to provide a small atomizing angle, it is necessary to provide a reduced divergent angle of a pintle. With a pintle having a small divergent angle, the shearing force may be reduced due to the contact of air on an inner peripheral side with air on an outer peripheral side, with the result that good finely-divided atomized particles cannot be supplied. If finely-divided atomized particles cannot be supplied, the evaporation of the liquid fuel requires an increased time, because the evaporation time for the atomized particles in the evaporation chamber is proportional to the square of the particle size of the atomized particles, so that the liquid fuel is supplied to the combustion space without reaching a preevaporated and premixed state. Unless a preevaporated and premixed combustion can be achieved, a low NOx combustion cannot be necessarily achieved.

If an increased atomizing angle is provided, the atomized particles may be adhered to an inner wall of the evaporation chamber. The particles adhered to the inner wall of the evaporation chamber are difficult to vaporize and hence, the evaporation of the liquid fuel may be impeded. For this reason, it is impossible to achieve a preevaporated and premixed combustion suitable for a low NOx combustion process. Further, with an increased atomizing angle, it is possible to provide a fine division of the atomized particles, but it is very difficult for the liquid fuel spreaded planarly in a filmed manner to be uniformly diffused within a three-dimensional space.

In this way, the prior art is accompanied by a problem that it is difficult to finely divide the liquid fuel and further to uniformly diffuse the finely-divided liquid fuel in the evaporation chamber, and it is impossible to provide a sufficient reduction in the amount of NOx.

Preheating of Liquid Fuel

In general, the boiling of a liquid fuel in a pipeline must be avoided for the purpose of a stable fuel supply.

However, the prior art fuel preheating method suffers from a problem that the liquid fuel is preheated to a temperature equal to or more than the boiling point in an ejection atmosphere and therefore, the liquid fuel may be boiled in the pipeline for the liquid fuel, resulting in a failure to realize a stable premixed combustion. Particularly, in an apparatus in which the load should be varied in correspondence to a demand for electric power, such as a combustor for an electricity-generating gas turbine, the pressure in the pipeline for the liquid fuel may be varied whenever the amount of fuel supplied is changed, resulting in a high possibility of the fuel boiling in the pipeline.

The boiling point of a liquid fuel comprising a single component can be distinctly defined, but the boiling point of a liquid fuel commonly used cannot be distinctly defined, because it is a mixture of components. For example, if the average value of boiling points of the components is defined as the boiling point of the liquid fuel, then there is a high possibility that the component having a lower boiling point than the average value may be boiled in the pipeline.

On the other hand, unless the temperature of the liquid fuel is raised to a certain extent, the atomized particles have increased particle sizes, and there is a large difference between the temperature of the liquid fuel and the boiling point, so that the fuel may be supplied in its unevaporated state to the combustion chamber.

The fuel supplied to the combustor may often be varied in type. In general, the fuel is supplied from a tank. If a different type of fuel is added to the tank, the fuel is replaced by the new fuel only after several hours or several days. During this time, the properties of the fuel and particularly the boiling point may be varied, which is accompanied by a danger that the fuel may be boiled in the pipeline, when the combustor is operated at a given temperature.

In order to evaporate the liquid fuel atomized into the evaporation chamber in a residence time which is within the self-firing time, as described above, it is desirable to control the temperature of the liquid fuel to a suitable level.

On the other hand, it is desirable that the combustor is capable of burning a variety of types of fuel for reasons of cost and practicality.

However, the prior art combustion apparatus suffers from a problem that a variety of types of fuel cannot be burned, because the fuel can be heated only to a signal predetermined temperature.

Treatment of Combustion Intermediate Product

As described above, among the combustion exhaust substances, NOx and CO are subject to control as being environmental pollution materials, and various provisions therefor have been made. However, unreacted intermediate materials other than NOx and CO are produced in the course of oxidation of the fuel which are not subject to control because there are only trace products and hence, the present situation is that any provisions therefor have not been made hithereto.

However, an influence of even the trace products on the environment cannot be underestimated. The combustion intermediate products become a problem in the combustion of an alcohol based fuel such as a methanol. In the combustion, i.e., oxidizing reaction of an alcohol based fuel, the fuel is converted via intermediate products into carbon oxides and water. However, if the combustion reaction is satisfactorily effected, the intermediate product such as aldehyde may be discharged outside the combustor, conjointly with the fact that such an intermediate product itself can be stably present. Another problem is that such an intermediate product cannot be treated satisfactorily in an existing device such as a denitration device which is placed rearwardly of the combustor.

SUMMARY OF THE INVENTION

Accordingly, it is a first object of the present invention to provide a combustor, a gas turbine apparatus, a combustion apparatus, a combustion method and a liquid fuel preheating method, wherein even with a liquid fuel, the amount of NOx can be reduced, while insuring a stable premixed combustion.

It is a second object of the present invention to provide a combustion apparatus and a preheating method, wherein any of various types of liquid fuel can be heated to a suitable temperature and burned.

It is a third object of the present invention to provide a combustion apparatus in which combustion intermediate products providing environmental pollution such as aldehyde easily produced in the course of combustion of an alcohol based fuel may be discharged to a lesser extent, and a method for treating combustion intermediate products.

To achieve the first object, according to the present invention, there is provided a combustor including a premixing type combustion burner which has an atomizer for ejecting a liquid fuel together with a combustion air to atomize the liquid fuel, wherein the atomizer is comprised of an inner shell to an inner peripheral surface of which the liquid fuel is supplied, an outer shell defining a passage for the combustion air running substantially straight between the outer shell itself and an outer peripheral surface of the inner shell, and a swirling-flow guide plate for swirling the combustion air passed into the inner shell, while directing it in a downstream direction, and the combustor further includes a resistor abruptly decreased in sectional area downstream and provided substantially downstream of the center of the swirling flow and in the vicinity of an outlet of the premixing type combustion burner for providing a resistance to a premixture ejected from the premixing type combustion burner.

In the above combustor, it is preferred that the inner periphery of the inner shell of the atomizer is increased in diameter toward its downstream side. Further, in the combustor, it is preferred that the inner and outer peripheral surfaces of the inner shell of the atomizer are connected at an acute angle at a downstream end of the inner shell, and the area of an opening in the inner shell is equal to the area of an opening between the inner and outer shells, and that the downstream end of the outer shell is located further downstream than the downstream end of the inner shell.

In addition, to achieve the first object, according to the present invention, there is provided a combustor including a premixing type combustion burner having a space in which a liquid fuel is mixed with combustion air, the combustor comprising a means for forming a swirling flow of the combustion air in the space, a means for forming a straightly running flow of the combustion air, flowing in a downstream direction, around the swirling flow, a means for supplying the liquid fuel to a boundary between the swirling flow and the straightly running flow, and a means provided substantially downstream of the center of the swirling flow and in the vicinity of an outlet of the premixing type combustion burner for forming a circulating flow of a combustion gas produced from the combustion of a premixture ejected from the premixing type combustion burner.

In such a combustor, the swirling-flow forming means may be comprised of an impeller or a nozzle disposed for swirling the combustion air. The circulating-flow forming means may be comprised of a resistor which is abruptly reduced in sectional area downstream.

Further, to achieve the first object, according to the present invention, there is provided a combustion apparatus including a combustor designed so that combustion air and an atomized liquid fuel are premixed with each other in a premixing type combustion burner and the resulting mixture is burned in a combustion chamber, the apparatus comprising a means for heating the liquid fuel to a range of temperatures not exceeding T° C., before the liquid fuel is supplied to the premixing type combustion burner, wherein T° C. represents a boiling point, in an atomized atmosphere, of one of the components of the liquid fuel, which has the lowest boiling point.

In this combustion apparatus, it is preferred that the heating means heats the liquid fuel to a temperature equal to or more than $T \times 0.8°$ C.

To achieve the second object, according to the present invention, there is provided a combustion apparatus comprising a means for discriminating the type of liquid fuel, a means for calculating the boiling point of one of the components of the liquid fuel discriminated in type, which has the lowest boiling point, a means for determining a heating temperature for the liquid fuel on the basis of the calculated boiling point, and means for heating the liquid fuel to the determined temperature.

In this combustion apparatus, the discriminating means may be designed to discriminate the type of the liquid fuel on the basis of physical property values provided before and after the liquid fuel is heated.

To achieve the third object, according to the present invention, there is provided a combustion apparatus including a combustor from which a burnable combustion intermediate product is discharged, the apparatus comprising an absorbing device in which an absorbing solution for absorbing the combustion intermediate product is reacted with the combustion intermediate product, and an absorbing solution ejecting device for ejecting the absorbing solution containing the combustion intermediate product absorbed therein into a combustion chamber in the combustor.

The term "combustor" embraces all combustors, for example, a combustor for a gas turbine, a boiler, a reactor in a chemical plant or the like, and an incinerator, if they are adapted to burn a fuel-air mixture after mixing a liquid fuel with a combustion air.

Premixed Combustion of Liquid Fuel

The combustion air flowing into the inner shell is formed into a swirling flow in the inner shell by the swirling-flow guide impeller. The swirling combustion air allows the liquid fuel supplied to the inner peripheral surface of the inner shell to be forced against the inner peripheral surface, thereby forming a liquid fuel film. In this case, if the inner peripheral surface of the inner shell is increased in diameter in a downstream direction, the liquid fuel in the film form is gradually reduced in thickness, as it flows downstream. This ensures that the liquid fuel can be finely divided.

The liquid fuel which has reached the downstream end of the inner shell is ejected to a boundary between the swirling flow formed in the inner shell and the straightly running flow formed between the inner and outer shells, where the liquid fuel is finely divided by reception of a shearing force under actions of the swirling flow and the straightly running flow which act in different directions. The preheating of the liquid fuel is very effective for the fine division of the fuel, and the heating of the fuel to near its boiling point ensures that the surface tension of the fuel can be considerably reduced, and the size of the atomized particles can be of about 40 μm which is substantially the limit for fine division.

The straightly running flow prevents the liquid fuel ejected from the inner shell from being adhered to the inner wall of the evaporation chamber. Also, the swirling flow attracts the atomized particles toward the center of swirling to prevent the liquid fuel from being adhered to the inner wall of the evaporation chamber. If the liquid fuel is adhered to the inner wall of the evaporation chamber, it is difficult to evaporate the adhered liquid fuel and it may be fed in a non-vaporized state to the combustion chamber, so that a dilute premixed combustion cannot be effected. This is the reason why the adhesion of the liquid fuel to the inner wall of the evaporation chamber is prevented.

In order to further effectively prevent the adhesion of the atomized particles to the inner wall of the evaporation chamber, it is preferred that the downstream end of the outer shell is located more downstream than the downstream end of the inner shell. The reason is that with such a construction, a straightly running flow can be reliably ensured in the vicinity of the inner wall of the evaporation chamber.

By spraying the liquid fuel in the film form into the swirling flow and the straightly running flow which are different in direction, it is possible to finely divide the liquid fuel more effectively and to prevent the adhesion of the fuel to the inner wall of the evaporation chamber.

The atomized particles of the liquid fuel are attracted toward the center of swirling under the influence of the swirling flow. If the area of passage for the straightly running flow, i.e., the area of the opening of the inner shell is equal to the area of passage for the swirling flow, i.e., the area of the opening between the inner and outer shells, a substantially uniform distribution of air velocity in the downstream direction within the evaporation chamber can be achieved. On the other hand, the amount of fuel per unit volume is larger at the center of the swirling flow and hence, the amount of fuel per unit amount of air is also larger. If this is considered from the viewpoint of the air ratio, the air ratio is lower at the center of swirling and increasingly higher towards the periphery of the swirling, i.e., towards the vicinity of the evaporation chamber.

In order to reduce the amount of NOx produced by a flame of a premixed liquid fuel, it is a common technique to burn the fuel-air mixture using an excess amount of air. As a result of zealous studies, the present inventors made it clear that if a high-temperature combustion gas is circulated to the center of a jet flow of a premixture of a sprayed fuel vapor and a combustion air, and the combustion air or the combustion gas is mixed with such a premixture before the premixture is burned, it is possible to stabilize the flame and to reduce the amount of NOx. The combustion gas introduced into the center of the premixture jet flow fires the premixture by a transfer of heat therefrom to provide a stabilization of the flame. This flame is propagated from the center of the jet flow to the outside of the jet flow. A mixture of the premixture and the combustion gas or the combustion air is formed around the outer periphery of the jet flow, and hence, the density of the fuel therein is lower, so that the thermal production of NOx is inhibited.

Further, in order to make this combustion method effective, it is important that no fuel droplet is contained in the premixture which is at least first fired, and that the varied velocity of the premixture at the outlet of the premixing burner is equal to or less than at least 10% of the main flow average velocity. If no fuel droplet is contained in the first-firing premixture, unevaporated fuel droplets present in the premixture can be evaporated as a result of an increase in temperature of a fuel-air mixture by a radiation from the flame, thereby realizing a dilute premixed combustion, thus achieving a low NOx combustion. If the variation in velocity of fuel-air premixture ejected is small, the fuel-air premixture will rarely back-fire, which makes it possible to realize a stable combustion.

One means for realizing such a combustion process is a flame holder. One of the flame holders having the simplest structure is a resistor abruptly reduced in sectional area downstream. If a jet flow collides against the resistor, a circulating flow is formed downstream of the resistor, and the high temperature combustion gas flows into the circulating flow, thereby providing an effect as described above.

One approach for promoting the mixing of the combustion gas or the combustion air from the periphery of the premixture jet flow is to provide a combustor structure in which a premixture can be ejected as a straightly running flow, and the combustion gas can be circulated around the premixture jet flow, or a combustor structure in which a premixture jet flow is ejected as a straightly running flow, and the combustion air can be circulated around the premixture jet flow.

Further, in order to promote the mixing of the premixture jet flow with the combustion gas or the combustion air, the premixture and the combustion gas or the combustion air may be ejected with a difference in velocity between the premixture jet flow and the combustion gas or the combustion air. Specifically, a combustion air passage or a combustion air nozzle is provided in close proximity to the premixing combustion burner, so that the velocity of combustion gas or combustion air ejected may be smaller than the velocity of premixture ejected.

In the present invention, the resistor is provided downstream of the swirling flow formed in the evaporation chamber, so that the air ratio of the fuel-air mixture is lower in the vicinity of the resistor and is increasingly higher in a direction away from the resistor. In such case, the air ratio at the center of the swirling flow, i.e., in the vicinity of the resistor may be of a level enabling firing with the aid of the high-temperature combustion gas. Even if the average air ratio of the premixture ejected from the premixing combustion burner is high, a stable flame can be formed.

Preheating of Liquid Fuel

The residence time in the evaporation chamber is preferred to be constant from the viewpoint of the evaporation of the fuel, but from the operational characteristic of the gas turbine, the amount of combustion air may be increased in some cases, resulting in a shortened residence time in the evaporation chamber. In such a case, the atomized particles flow into the combustion chamber without being completely evaporated, and for this reason, a dilute premixed combustion cannot be achieved to provide a reduction in the amount of NOx.

Conversely, the amount of combustion air may be reduced in some cases, resulting in a prolonged residence time of the atomized particles. If the residence time is too long, however, the atomized particles may be ignited in the evaporation chamber, with the result that the combustor cannot be operated in safety.

Thereupon, in order to completely evaporate the atomized particles before self-ignition thereof, it is preferred that the liquid fuel is preheated before atomization thereof.

The heating temperature range may be as follows:

$$X°C. \geqq \text{temperature}°C. \text{ of liquid fuel} \geqq X \times 0.8° C.$$

wherein X represents the boiling point, in an atomized atmosphere, of that one of the components of the liquid fuel, which has the lowest boiling point.

The determination of an upper limit of the heating temperature at X°C. ensures that even if the pressure in the liquid fuel piping is varied in order to vary the amount of liquid fuel supplied, the component having the lowest boiling point is scarcely boiled in the piping, so that the combustor can be operated stably.

Until the atomized particles are evaporated after being ejected from the atomizer into the evaporation chamber, it takes a time corresponding to the sum of the heating time required for the atomized particles to be heated up to a boiling point and the evaporating time required for the atomized particles to be evaporated after reaching the boiling point.

The determination of a lower limit of the heating temperature at $X \times 0.8°$ C. ensures that little heating time is required. In addition, the surface tension of the liquid fuel can be reduced down to a very small value and hence, the particle size of the atomized particles can be reduced to substantially near a limit. The evaporating time can be also very shortened, because the square of the particle size is proportional to the evaporating time. Therefore, if the liquid fuel is preheated in this manner, the atomized particles are evaporated in a very short time, ensuring that the residence time of the atomized particles in the evaporation chamber can be set to less than the self-ignition time, and the atomized particles can be evaporated within the residence time. If the atomized particles can be reliably evaporated in the evaporation chamber, the fuel cannot be burned in an atomized droplet state and hence, a reduction in the amount of NOx can be provided.

It is preferred for reasons of cost and practicality that the combustor such as a combustor for a gas turbine, a boiler and an incinerator is capable of burning any of a variety of types of fuel, as described above, but the operation control is difficult and cannot be realized, because the flow characteristic or the like of the fuel may be varied depending upon the type of the fuel.

Thereupon, according to the present invention, the means for discriminating the type of the liquid fuel is provided, and the heating means for heating the fuel in accordance with the discriminated type is provided.

The heating of the fuel in accordance with the type thereof ensures that even with a different type of liquid fuel, the flow characteristic thereof and the like can be kept constant, and a stable operation can be always carried out.

The type of the liquid fuel can be discriminated by previously determining a relationship between the temperature and the density, the partial pressure of vapor, the surface tension, the light-refractive index and the like for every liquid fuel and actually measuring values of such parameters of a fuel to be discriminated, and comparing the measured values with the predetermined values.

To make a more accurate discrimination, the measurement may be carried out at two places upstream and downstream of the preheater, and the type may be discriminated in the light of resulting values. Alternatively, different physical properties such as the density and the surface tension may be measured at two places.

The liquid fuel generally consists of a plurality of components and hence, the boiling point of the liquid fuel cannot be distinctly determined. Thereupon, the heating temperature may be determined on the basis of the boiling point of one of the components which has the lowest boiling point. This is because it is possible to prevent a boiling in a place where the boiling therein is not preferred, such as in the pipeline.

Treatment of Combustion Intermediate Products

For example, when an alcohol based fuel is burned, combustion intermediate products such as aldehyde are produced. This product pollutes the atmosphere, but is presently rarely treated, because it is not subjected to control.

Thereupon, the provision of an absorbing-solution spraying device for spraying an absorbing solution for absorbing the product in an exhaust gas line ensures that the combustion intermediate product can be removed from an exhaust gas.

The combustion intermediate product is ejected into the combustion chamber together with the absorbing solution by the absorbing-solution spraying device. The combustion intermediate product is brought into contact with the high-temperature combustion gas in the combustion chamber and thermally decomposed, for example, into $H_2O$ and $CO_2$. On the other hand, a flame is cooled by the absorbing solution, leading to a reduced amount of thermal NOx.

By absorbing the combustion intermediate product in the absorbing solution and spraying the product-absorbed solution into the combustor, it is possible to reduce the amount of thermal NOx and to treat and remove the combustion intermediate product.

When the combustor permitting the production of the combustion intermediate product is used in the gas turbine, it is preferable that sprayed particles of the absorbing solution have a particle size as small as possible, and the flow rate of the absorbing solution is limited to such a level that all the solution can be evaporated in the combustor. This is because unless the evaporation in the combustion chamber is totally completed, not only can the temperature in the combustion chamber due to the evaporation not be expected to be satisfactorily reduced, but also unevaporated droplets collide against the turbine blade to cause an erosion.

The above and other objects, features and advantages of the invention will become apparent from a reading of the following description of the preferred embodiments, taken in conjunction with the accompanying drawings.

BRIEF DESCRIPTION OF THE DRAWINGS

FIGS. 1 to 7 illustrate a first embodiment of the present invention, wherein

FIG. 1 is a sectional view of an essential portion of a combustor;

FIG. 2 is a sectional view taken along a line II—II in FIG. 1;

FIG. 3 is a sectional view of the entire premixing type combustion burner;

FIG. 4 is a view for explaining a burned state;

FIG. 5 is a graph illustrating an air ratio distribution in an evaporation chamber;

FIG. 6 is a sectional view of a combustor used for a test; and

FIG. 7 is a graph illustrating the relationship between the air ratio and the concentration of NOx;

FIGS. 8 and 9 illustrate a second embodiment of the present invention, wherein

FIG. 8 is a systemic diagram of a gas turbine-combined electric power plant apparatus; and FIG. 9 is a sectional view of a combustor.

DETAILED DESCRIPTION OF THE PREFERRED EMBODIMENTS

The present invention will now be described by way of a first embodiment in connection with FIGS. 1 to 7.

Figure 1:
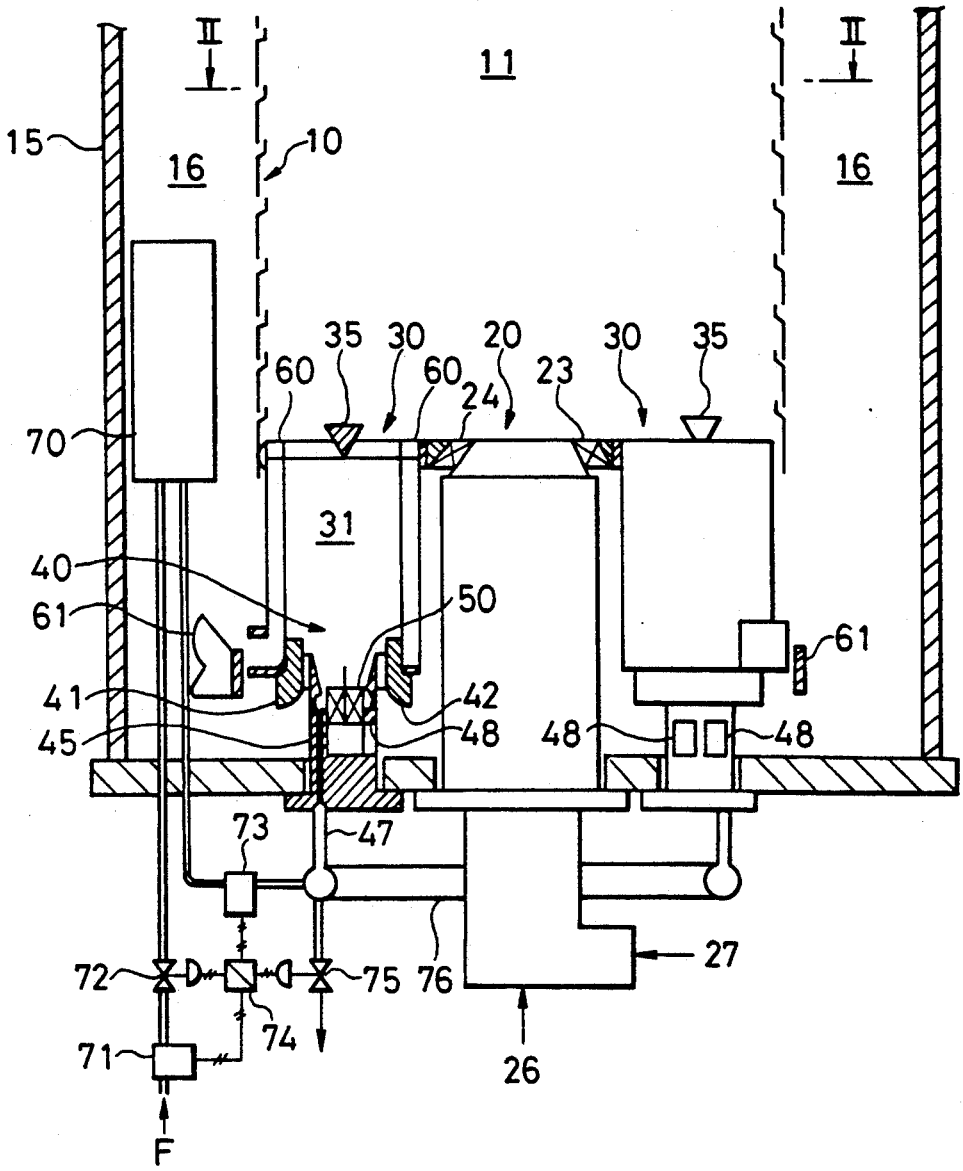
Figure 2:
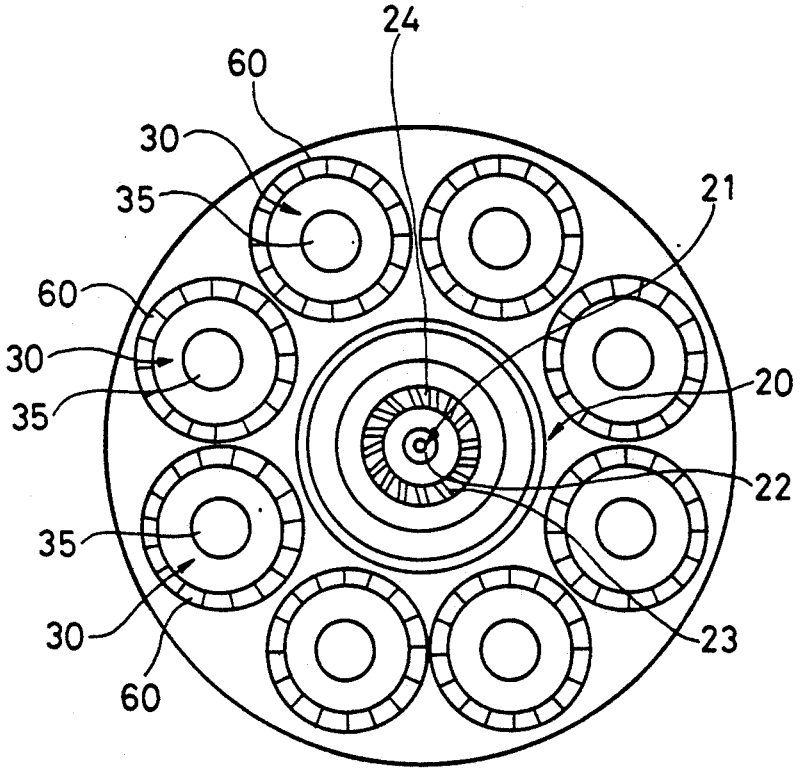

Referring to FIGS. 1 and 2, a combustor according to the first embodiment is used for a gas turbine and comprises a combustion cylinder 10, a pilot burner 20 placed upstream of the combustion cylinder 10 in an extension of the center of the combustion cylinder 10, a plurality of premixing type combustion burners 30, 30—disposed radially around the pilot burner 20, a preheater 70 for a liquid fuel, and a casing 15 which contains the preheater 70 therein.

The interior of the combustion cylinder 10 is a combustion chamber 11, and an annular passage defined between the combustion cylinder 10 and the casing is a wind box 16.

The premixing type combustion burner 30 is comprised of an atomizer 40 for atomizing the liquid fuel, and an evaporation chamber 31 in which the atomized liquid fuel is evaporated and premixed with combustion air.

The atomizer 40 is disposed upstream of the evaporation chamber 31 and comprises an outer cylindrical shell 41, an inner cylindrical shell 45 concentrically mounted in the outer cylindrical shell 41, and a swirler 50 provided to form a swirling flow of the combustion air in the inner shell 45.

Figure 3:
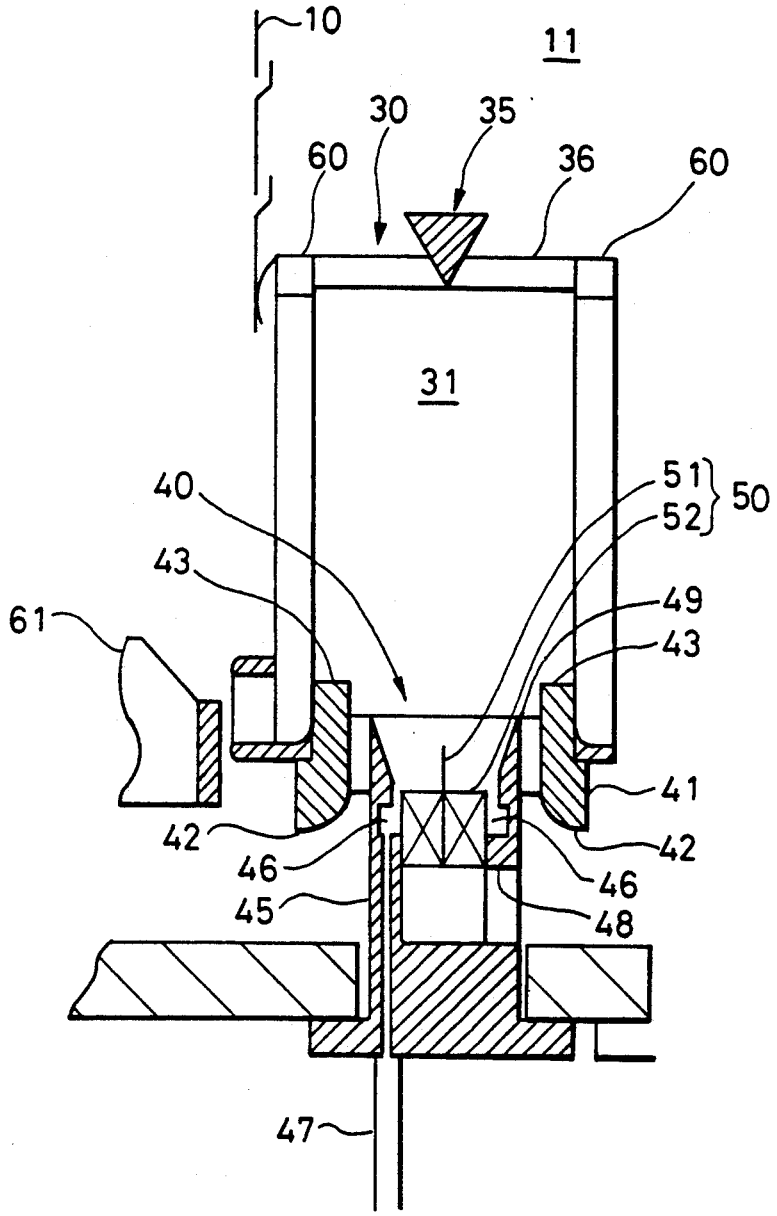

The inner cylindrical shell 45 has an inner downstream peripheral surface which is gradually enlarged in diameter in a downstream direction, as shown in FIG. 3, and a downstream end 49 in contact with an outer peripheral surface of the inner shell 45, which end is formed to have a knife-edge like section, so that the inner and outer peripheral surfaces of the inner shell 45 are connected with each other at an acute angle. A fuel reservoir 46 is provided in an inner surface of the inner cylindrical shell 45 at a downstream portion thereof. A fuel supply pipe 47 is connected to a fuel distributer 76 and also to the fuel reservoir 46. Further, the inner cylindrical shell 45 has an air inlet hole 48 provided at its upstream portion for permitting the combustion air in the wind box 16 to be passed therethrough into the inner shell 45.

The swirler 50 provided within the inner cylindrical shell 45 is comprised of a columnarly formed support 51 provided centrally of the inner cylindrical shell 45, and a plurality of swirl guide impellers 52 radially provided on the support 51.

Provided upstream of the outer cylindrical shell 41 is an air inlet hole 42 for permitting the combustion air in the wind box 16 to be passed therethrough into an air passage defined between the inner and outer cylindrical shells 45 and 41. The air inlet hole 42 is formed into a bell shaped mouth to reduce the resistance of air flowing thereinto. A downstream end 43 of the outer cylindrical shell 41 is located further downstream than the downstream end 49 of the inner cylindrical shell 45.

The area of the air passage in the inner cylindrical shell 45 is substantially equal to that of the air passage defined between the inner and outer cylindrical shells 45 and 41, so that the flow rates of the combustion air flowing through these air passages are equal to each other.

A conical resistor 35 having an apex directed in an upstream direction is provided at a downstream end of the evaporation chamber 31, i.e., substantially centrally in the vicinity of an outlet in each of the premixing type combustion burners 30. The resistor 35 is supported by a resistor support 36 mounted on an inner peripheral surface of the evaporation chamber 31.

An air nozzle 60 is provided around a periphery of each of the premixing type combustion burners 30 for ejecting the combustion air. The air nozzle 60 communicates with the wind box 16, and an air flow rate control valve 61 is mounted at such a communication place for controlling the flow rate of the combustion air.

The pilot burner 20 is provided at its central portion with a pilot fuel nozzle 21 for ejecting a pilot fuel 26 in a conical film form. A finely-dividing air nozzle 22 is mounted around the pilot fuel nozzle 21 for ejecting air for finely dividing a film-like pilot fuel 26 into finely-divided fuel droplets. Further, an air nozzle 23 is mounted around the finely-dividing air nozzle 22 for ejecting air for combustion of the pilot fuel. A swirler 24 is provided within the air nozzle 23 for swirling the combustion air ejected from the air nozzle 23.

The preheater 70 is mounted within the wind box to heat the liquid fuel by utilizing the heat of the heated combustion air.

The preheater 70 is connected at its upsteam portion to a fuel tank which is not shown. Provided between the preheater 70 and the fuel tank are a measuring means 71 for measuring the density and temperature of the liquid fuel, and a fuel flow rate control valve 72 for controlling the flow rate of the liquid fuel supplied to the preheater 70. The downstream end of the preheater 70 is connected to the fuel distributer 76 for supplying the liquid fuel in equal amounts to the premixing type combustion burners 30, 30, - - - . A measuring means 73 is provided between the fuel distributer 76 and the preheater 70 for measuring the density and temperature of the liquid fuel. The fuel distributer 76 is provided with a fuel return valve 75 for returning the fuel back to the fuel tank.

A control system 74 is connected to the fuel flow rate control valve 72 and the return valve 75 for controlling these valves 72 and 75 in response to signals from the measuring means 71 and 73. The control system 74 has a function for discriminating the type of the liquid fuel on the basis of the results of measurement in the measuring means 71 and 73, a function for calculating the boiling point, in a fuel-ejected atmosphere, of that one of the components of the discriminated liquid fuel, which has the lowest boiling point, and a function for determining a temperature for heating the fuel on the basis of the calculated boiling point to control the opening degree of each of the valves 72 and 75.

The operation of this embodiment will be described below.

First, the operation of the pilot burner 20 will be described.

The pilot fuel 26 is ejected in a conical film-like form from the pilot fuel nozzle 21 into the combustion chamber 11. The finely-dividing air 27 is ejected at a rate in the range of about 100 to 200 m/sec from the finely-dividing air nozzle 22 toward the pilot fuel 26 ejected in the conical film-like form. The finely-dividing air 27 causes a strong shearing force to act on the liquid film of the pilot fuel 26 to finely divide the pilot fuel 26.

The finely-divided pilot fuel 26 is burned with the aid of the combustion air ejected from the air nozzle 23. In this case, the combustion air is formed into a swirling flow by the swirler 24 provided within the air nozzle 23, so that an upstream-directed flow is formed downstream of the pilot fuel nozzle 21 which is around the swirling flow. Therefore, a combustion gas at a high temperature flows thereinto, so that the finely-divided pilot fuel is heated and ignited.

A flame produced from the pilot burner 20 is a so-called diffusion flame formed by the combustion air ejected from the separate nozzles 21 and 23 and the pilot fuel 26. For this reason, the pilot flame is formed stably, even if the amount of fuel supplied is varied. However, a higher temperature region in which a fuel-air mixture is burned at a theoretical air ratio is necessarily formed in the diffusion flame and hence, a large amount of NOx may be produced. To prevent this, the pilot burner 20 may be primarily utilized in the event of a smaller loading such as during start up of the combustor, and the premixing type burner 30 may be primarily utilized in the event of increased loading.

Description will now be made of the combustion of the fuel in the premixing type burner 30 and the preheating of the liquid fuel supplied to the premixing type burner 30.

The liquid fuel supplied from the fuel tank (not shown) to the premixing type combustion burners 30, 30, - - - is preheated by the preheater 70.

Such a preheating technique will be described below in detail.

The density and temperature of the liquid fuel are measured by the measuring means 71 and 73. A relationship between the density and the temperature of the liquid fuel of each type has been determined by a test, and the control system 74 discriminates the type of the liquid fuel from such a relationship and the results of measurement and calculates a boiling point, in the fuel-ejected atmosphere, of the one of the components of the liquid fuel having a lowest boiling point. The heating temperature for the liquid fuel is determined on the basis of the calculated boiling point.

The type of the liquid fuel is discriminated to determine the heating temperature in this manner and therefore, even with a different type of liquid fuel, a heating temperature suitable for such a liquid fuel can be determined. The measuring means 71 and 73 are provided upstream and downstream of the preheater 70, respectively. This is for the purpose of accurately determining the physical properties of the liquid fuel and discriminating the type of the liquid fuel. Although the type of the liquid fuel has been discriminated on the basis of the density in this embodiment, it is to be understood that the type of the liquid fuel may be discriminated on the basis of various physical property values such as surface tension, partial pressure of vapor and light-refractive index.

The heating temperature is set in a temperature range defined in the following manner:

$$X°C. \geqq \text{heating temperature} \geqq X \times 0.8° C.$$

wherein X represents the calculated boiling point.

The determination of an upper limit at X°C. ensures that even if the pressure in the liquid fuel piping is varied in order to change the amount of liquid fuel supplied, the component having the lowest boiling point will be scarcely boiled within the piping.

The lower limit of the heating temperature has been determined by a test to be a value at which the liquid fuel can be finely divided efficiently.

A relationship between the fine-division and the temperature of the liquid fuel will be described hereinafter.

The preheated liquid fuel is supplied to the premixing type combustion burner 30. In the premixing type combustion burner 30, the liquid fuel is atomized by the atomizer 40; evaporated and premixed in the evaporation chamber 31 and burned at the burner outlet.

An atomizing step, an evaporating and premixing step and a burning step will be sequentially described below.

The preheated liquid fuel is supplied via the fuel distributer 76, the fuel supply piping 47 and the fuel reservoir 46 to the inner peripheral surface of the inner cylindrical shell at its upstream portion.

The combustion air flowing into the inner cylindrical shell 45 is formed into a swirling flow in the inner cylindrical shell by the swirler 50. The swirling combustion air causes the liquid fuel supplied to the inner peripheral surface of the inner cylindrical shell 45 to be forced onto the inner peripheral surface to provide a film form. Because the inner peripheral surface is gradually increased in diameter in the downstream direction, the liquid fuel in the film form is gradually reduced in thickness, as it flows downwardly.

The liquid fuel which has reached the downstream end of the inner cylindrical shell 45 is ejected to an interface between the swirling flow formed in the inner cylindrical shell 45 and a straightly-running flow formed between the inner and outer cylindrical shells 45 and 41, where it is finely divided by being acted upon by a shearing force caused by the actions of the swirling flow and the straightly running flow. The preheating of the liquid fuel is very effective for finely dividing the fuel, wherein the surface tension of the fuel is considerably reduced by heating the fuel up to near its boiling point, and particles having a diameter of about 40 μm are formed substantially at a limit of fine-division.

The flow rates of air suitable for forming the swirling flow and the straightly-running flow are substantially equal to each other, because the areas of the air passages therefor are equal to each other. For this reason, the downstream flow velocities are also equal to each other, thereby ensuring that the straightly running flow and the swirling flow are less disturbed and can be relatively maintained to a downstream side.

The straightly running flow inhibits the liquid fuel ejected from the atomizer 40 from being adhered to an inner wall of the evaporation chamber 31. If the liquid fuel is adhered to the inner wall of the evaporation chamber 31, it is difficult to fully evaporate the adhered liquid fuel, and the liquid fuel in its unvaporized state is passed into the combustion chamber 11. If the unvaporized liquid fuel is burned, a large amount of NOx is produced as in the diffusion combustion. Also to prevent this, it is of great significance to form the straightly running flow along the inner wall of the evaporation chamber 31.

On the other hand, the swirling flow attracts the atomized particles of the liquid fuel to the center of swirling. For this reason, the concentration of the atomized particles in the evaporating chamber 31 is higher in the vicinity of a central axis of the atomizer 40 and reduced toward the inner wall of the evaporating chamber 31. Because the air velocity distribution in the evaporating chamber 31 is substantially even, as described above, the proportion of the atomized particle flow rate per a unit air flow rate is reduced from the central axis of the atomizer toward the outer periphery of the atomizer. If the concentration of the atomized particles is considered from the viewpoint of the air ratio, the air ratio is increased from the central portion of the evaporating chamber 31 toward the inner peripheral wall of the evaporating chamber 31.

The swirling flow also contributes to a prevention of adhesion of the atomized particles to the inner wall of the evaporating chamber 31 by attracting the atomized particles toward the center of swirling.

The atomized particles are heated and evaporated by the combustion air heated to about 350° C., and then mixed with the combustion air to form a premixture (premixed gas) in the course of flowing downward from the evaporating chamber 31.

After being ejected from the atomizer 40, it takes an amount of time for the atomized particles to be heated to boiling point (heating time) and a further time for them is be fully evaporated (evaporating time). The heating time required is small, because the liquid fuel has been heated to near the boiling point by the preheater 70. The evaporating time required for the atomized particles reduced in particle size down to near a limit is also very short, because it is proportional to the square of the particle size.

Therefore, the atomized particles are evaporated in a very short time and hence, it is possible to set the residence time for the atomized particles in the evaporation chamber to be within the self-ignition time and to evaporate the atomized particles within the residence time.

A test carried out for the air ratio distribution at the outlet in the evaporation chamber will be described below.

The testing conditions are as follows: The diameter of an inner periphery of the evaporating chamber: 80 mm, the velocity of air flowing through the evaporating chamber: 70 m/sec., the length of the evaporating chamber: 0.3 m, the velocity of air ejected for the downstream swirling and straightly-running flows at the outlet of the atomizier: 140 m/sec., the angle of the swirling-flow guide impeller with respect to a central axis: 30° C.

Figure 5:
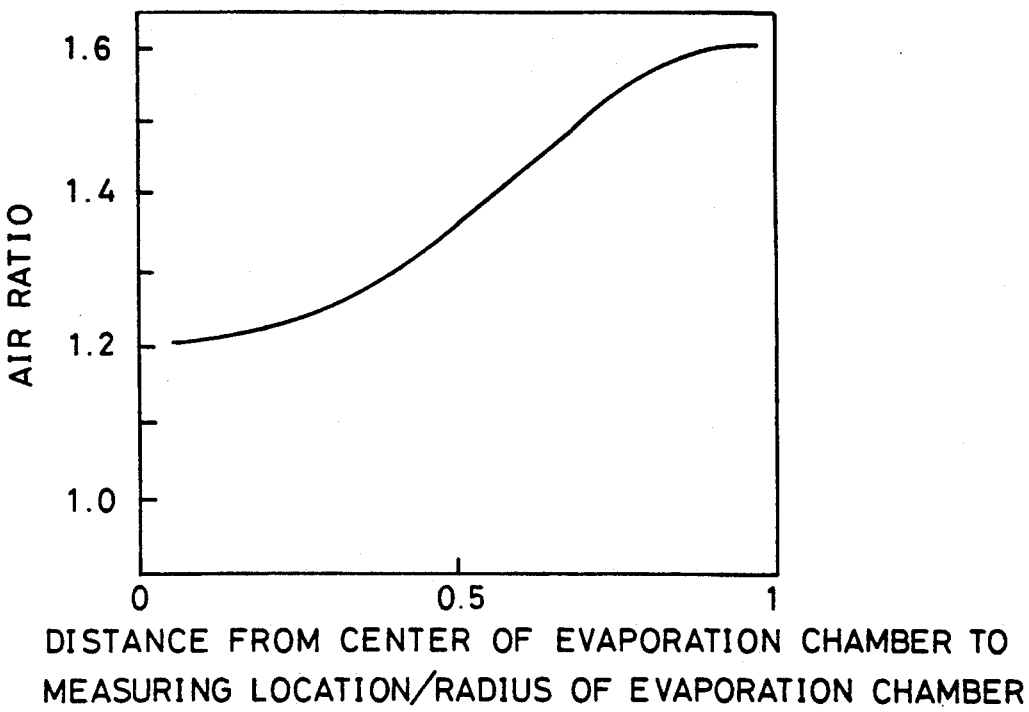

The results of the test under such conditions are given in FIG. 5, wherein the axis of the ordinate indicates the air ratio, and the axis of abscissa indicates the value resulting from division of the distance from the center of the evaporation chamber to the air ratio measuring position by the radius of the evaporation chamber.

As a result of this test, the air ratio was 1.2 in the vicinity of the center of the evaporating chamber and 1.6 in the vicinity of the inner wall of the evaporation chamber, and the average air ratio was of 1.4. The air ratio in the vicinity of the inner wall of the evaporation chamber was about 30% higher than that in the vicinity of the center of the evaporation chamber.

The premixture having such an air ratio distribution is ejected from the premixing type combustion burner 30 and burned.

Figure 4:
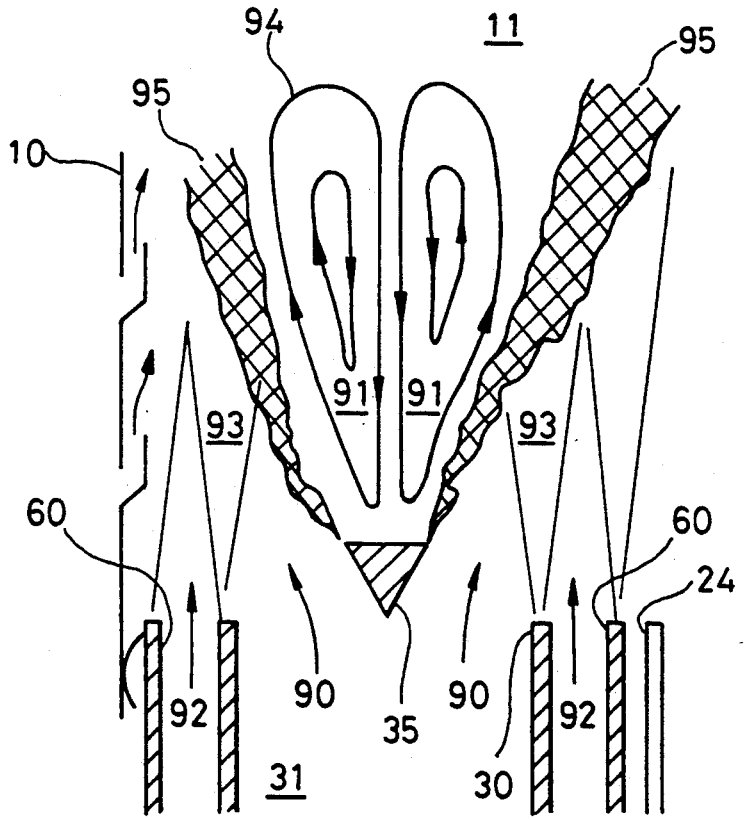

The premixing and burning step will be described with reference to FIG. 4.

The premixture 90 ejected from the premixing type burner 30 collides against the resistor 35 to form a circulating flow region 91 downstream of the resistor 35. In the circulating flow region 91, the premixture flows in an upstream direction in the central area of the resistor 35 and in a downstream direction in the peripheral area of resistor 35.

A region 93 of dilute premixing of the premixture 90 and the combustion air 92 is defined in a boundary between the premixing type burner 30 and the air nozzle 60.

The combustion gas 94 produced from the combustion of the premixture 90 flows into the circulating flow region 91, so that the circulating flow region 91 is thereby heated to a high temperature.

The high-temperature combustion gas 94 in the circulating flow region 91 ensures that the premixture 90 reaches an ignition temperature and is ignited to form a burning region 95 downstream of the periphery of the resistor 35.

If the air ratio distribution in the combustion chamber 11 is now considered, the air ratio is increasingly higher in a direction away from the resistor 35. This is because a premixture 90 of a lower air ratio is ejected from the premixing type burner 30 to the vicinity of the resistor 35, and the combustion air 92 is ejected from the air nozzle 60 provided around the premixing type burner 30.

The premixture 90 is first brought into contact with the high-temperature combustion gas 94 downstream of the resistor 35 and burned to form a stabilized premixed flame. Then, the flame is propagated to an outer peripheral area which has a higher air ratio whereby it is difficult to provide a stable combustion, thereby providing a stabilized combustion of a dilute premixture. It should be noted that NOX produced is reduced with an increase in air ratio and hence, the concentration of NOX produced by combustion of the premixture of a higher air ratio around the outer periphery is very low.

In general, in order to provide a reduction in NOX, the air ratio distribution of the premixture is made uniform, but in the present embodiment, the air ratio at the center of the premixing type burner 30 is intentionally lowered, and a premixture 90 having a lower air ratio is passed close to the resistor 35, thereby providing a stabilization of combustion.

In order to stabilize the combustion, it is also necessary to minimize the variation in velocity of the premixture 90 at the outlet of the premixing type burner 30. This is because when the velocity is reduced instantaneously, the flame flows back to the inside of the evaporation chamber 31. The results of various tests showed that if a value resulting from division of the varied velocity by an average velocity is equal to or less than about 10%, a stable combustion can be achieved. For example, if the combustion air is supplied from the middle of the evaporation chamber 31 to provide an increased intensity of a turbulent flow and an increased uniformity of a primary mixed gas, there is an increased variation in velocity at the outlet of the premixing type burner 30, with the result that the combustion is unstable, and a back flow of the flame to the evaporating chamber is apt to be produced.

In addition, in the present embodiment, if an air ratio is ensured which is enough for only the premixture at the center of the premixing type burner 30 to be ignited by a high temperature circulating flow formed downstream of the resistor 35, it is possible to provide a stabilization of flame and therefore, it is not necessary to set the air ratio of the entire premixture 90 ejected from the premixing type burner 30 at a level enabling the ignition. This makes it possible to increase the average air ratio of the entire premixture 90 to provide a reduction in the amount of NOx.

A test conducted for an effect of the air nozzle 60 mounted around the premixing type burner 30 will be described below.

Figure 6:
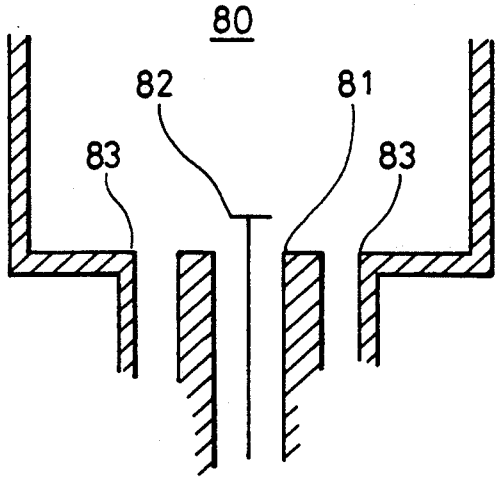

A combustor used in this test comprises a premixing type combustion burner 81 having an inside diameter of 50 mm and mounted at a central location upstream of a combustion chamber 80 having an inside diameter of 200 mm, a disk-like resistor 82 having an outside diameter of 36 mm and mounted downstream of the burner 81, and an annular air nozzle 83 having an inside diameter of 68 mm and an outside diameter 78 mm and provided around the burner 81, as shown in FIG. 6.

The test was conducted to measure the concentration of NOx at a combustor outlet in a case where a premixture was ejected from the premixing type burner 81 and a combustion air was ejected from the air nozzle 83, and in a case where the premixture was ejected from only the premixing type burner 81 and no combustion air was ejected from the air nozzle 83.

Figure 7:
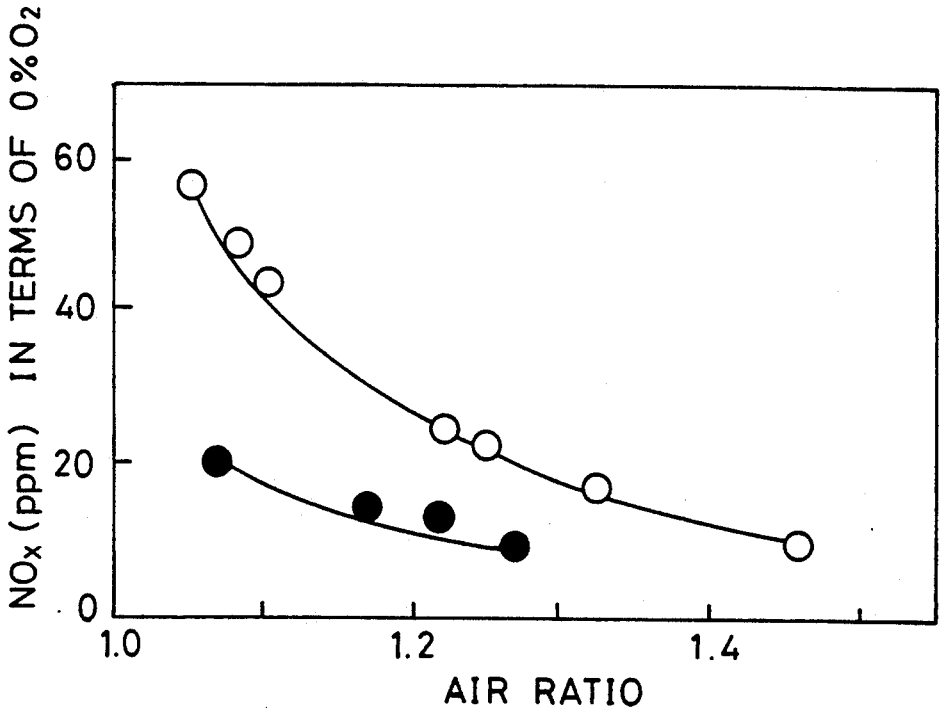

The results of such measurement are given in FIG. 7, wherein the axis of the ordinate indicates the concentration of NOx at the combustor outlet and is corrected in such a manner that the concentration of oxygen at the combustor outlet is of 0%, and the axis of abscissa indicates the air ratio in the premixing type burner 81. In addition, in FIG. 7, the black circle corresponds to the case where the premixture was ejected from the premixing type burner 81 and the combustion air was ejected from the air nozzle 83, and the white circle corresponds to the case where the premixture was ejected from only the premixing type burner 81 and no combustion air was ejected from the air nozzle 83.

It was confirmed in this test that NOx could be reduced at the same air ratio by separately supplying the combustion air from the outer peripheral side of the premixing type burner 81, as compared with a case where no combustion air was separately supplied.

Therefore, it is also possible in the present invention to reduce the amount of NOx by supplying the combustion air from the air nozzle 60 to around the premixture to form a dilute premixture in the same manner as in this test.

Figure 8:
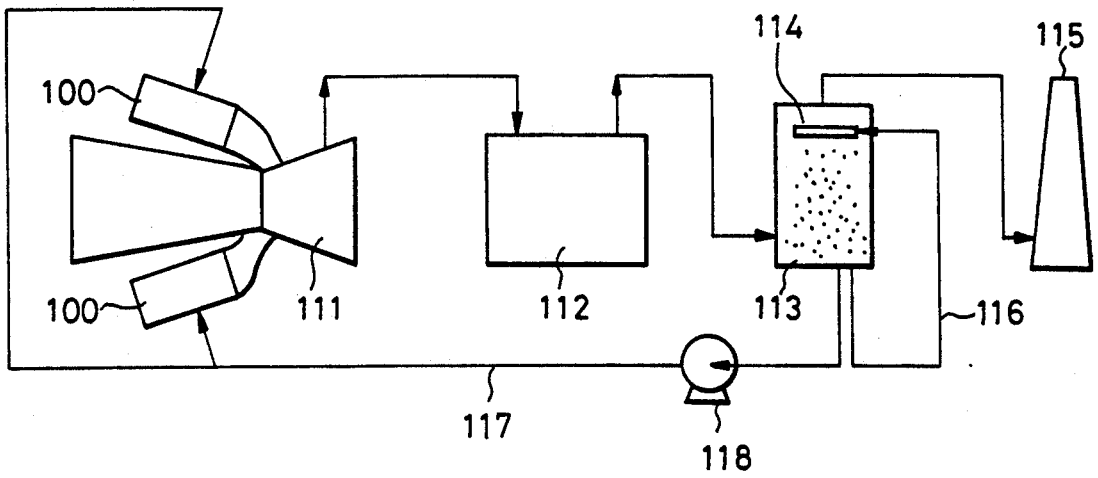

A second embodiment of the present invention will now be described in connection with FIGS. 8 and 9.

A gas turbine-combined electric power apparatus of the present embodiment is comprised of a combustor 100, a gas turbine 111 connected to the combustor 100, and a denitration device (not shown), a waste-heat recovery boiler 112, an absorption tower 113 and a smokestack 115, which are disposed in sequence downstream of the gas turbine 111.

A spray nozzle 114 is mounted in an upper portion of the absorption tower 113 for spraying water downwardly. Connected to a bottom portion of the absorption tower 113 are a circulating pipe 116 for supplying the water accumulated in the bottom of the tower back to the spray nozzle 114, and a supply pipe 117 for supplying the water accumulated in the bottom of the tower back into the combustor 100. A supply pump 118 is mounted in the supply pipe 117.

Figure 9:
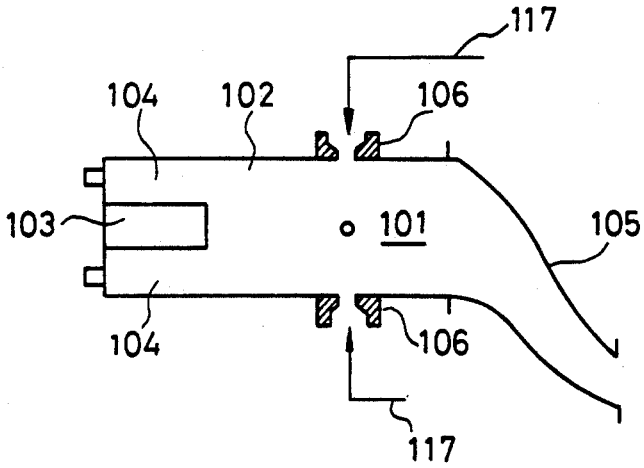
Figure 10:
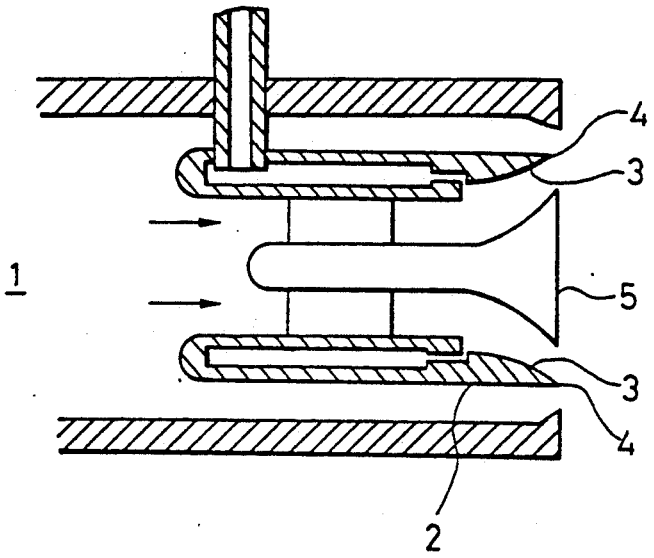
FIG. 10 PRIOR ART
FIG. 10 is a sectional view of the prior art atomizer.

As shown in FIG. 9, the combustor 100 is comprised of a combustion cylinder 102 defining a combustion chamber 101, a pilot burner 103 and premixed type combustion burners 104, 104. - - - provided upstream of the combustion cylinder 102, and a transducer 105 provided downstream of the combustion cylinder 102.

At a location corresponding to two-thirds of a length of the combustion cylinder 102 from its upstream side to its downstream side, there are orifices 106, 106, 106 opened to the inside of the combustion chamber 101. The supply pipe 117 extending from the absorption tower 113 is connected to the orfices 106.

Each orifice 106 is designed so that water can be sprayed therethrough by utilizing a water supply pressure. An opening diameter of the orifice is set in such a manner that the flow rate of water ejected from the orifice 106 can be restrained at a level suitable for such water to be evaporated before reaching a central portion of the combustion cylinder 102. The restraint of the flow rate of the sprayed water by the orifice 106 is for the purpose of preventing the water from being supplied in its unevaporated form to the gas turbine 111.

The operation of this embodiment will be described below.

In this embodiment, an alcohol is used as a fuel for the combustor 100.

If the alcohol is burned, an aldehyde which is an intermediate combustion product is produced and supplied together with an exhaust gas to the gas turbine 111. The exhaust gas containing the aldehyde drives the gas turbine 111 and is then passed through the denitration device (not shown) and the waste-heat recovery boiler 112 to a lower portion of the absorption tower 113.

In the absorption tower 113, water is sprayed downwardly from the spray nozzle 114 to come into contact with the exhaust gas flowing upwardly, so that the aldehyde in the exhaust gas is absorbed into the water. The aldehyde-absorbed water is accumulated in the bottom of the tower 113, and a portion thereof is supplied through the circulating pipe 116 back to the spray nozzle 114. Another portion of such water is passed through the supply pipe 117, compressed by the supply pump 118 and sprayed into the combustion chamber 101 through the orifices 106, 106.

The sprayed water is brought into contact with a gas at an increased temperature equal to or more than 1400° C. in the combustion chamber 101. The sprayed water reduces the temperature of the increased-temperature gas by a latent heat of vaporization. Such a reduction in temperature ensures that nitrogen in the air is difficult to oxidize, and the amount of NOx produced is reduced. Further, the aldehyde absorbed in the water is thermally decomposed into $H_2O$ and $CO_2$ by the increased-temperature gas and discharged from the combustor 100 together with the exhaust gas.

By absorbing the aldehyde as an intermediate combustion product into the water and spraying the aldehyde-absorbed water into the combustor 100 in this manner, it is possible to treat and remove the aldehyde as an intermediate combustion product and to provide a reduction in the amount of NOx.

Although the orifices 106 have been provided at the location corresponding to two thirds of the length of the combustion cylinder 102 from its upstream side to its downstream side in the present invention, this being for the purpose of spraying the aldehyde-containing water into the vicinity of a leading end of a flame, it will be understood that if the position of a leading end of a flame is different structurally within the combustor, it is preferable to provide orifices at a different location in correspondence to the position of the leading end.

In addition, although an alcohol-based fuel from which an aldehyde as an intermediate combustion product is produced has been used in the present embodiment, it will be understood that any fuel may be used if it produces an intermediate combustion product capable of being absorbed in water.

What is claimed is:

1. A combustor including a premixing type combustion burner having an evaporation chamber for ejecting a premixture from a downstream end of said evaporation chamber, said premixture being produced by premixing combustion air from an upstream direction and a liquid fuel evaporated in said combustion air, said combustor further comprising:

a means for forming a swirling flow of the combustion air in said evaporating chamber;

a means for forming a straightly running flow of the combustion air, flowing in a downstream direction, around swirling flow;

a means for supplying said liquid fuel to a boundary between said swirling flow and said straightly running flow; and a means provided over a swirling flow of said premixture, being positioned slightly downstream from an end of said evaporation chamber, for forming a circulating flow of a combustion gas produced from the combustion of a premixture ejected from said premixing type combustion burner.

2. A combustor including a premixing type combustion burner which has an atomizer for atomizing a liquid fuel in combustion air from an upstream direction, and an evaporation chamber in which the atomized fuel is evaporated and premixed with the combustion air to form a premixture which is ejected from an outlet of said premixing type combustion burner at a downstream end of said evaporation chamber said atomizer comprising an inner shell having an inner peripheral surface to which said liquid fuel is supplied, an outer shell defining a passage in which combustion air can substantially straightly flow in a downstream direction between the outer shell and an outer peripheral surface of said inner shell, and a swirling-flow guide plate for swirling combustion air passed into the inner shell, while directing the combustion air in the inner shell in a downstream direction; and said combustor further including a resistor abruptly increasing in width in a downstream direction and provided substantially downstream of the center of the swirling flow and in the vicinity of said outlet of said premixing type combustion burner for providing a resistance to the premixture ejected from said premixing type combustion burner and forming downstream of said resistor a circulating flow of combustion gas produced by combustion of said premixture, which circulating flow flows in upstream and downstream directions.

3. A combustor according to claim 2, wherein the inner shell of said atomizer has an inner periphery increased in diameter in a downstream direction.

4. A combustor according to claim 2, wherein the inner and outer peripheral surfaces of the inner shell of said atomizer are connected with each other at an acute angle at the downstream end of said inner shell.

5. A combustor according to claim 2, wherein the area of an opening in said inner shell is substantially equal to the area of an opening between said inner and outer shells.

6. A combustor according to claim 2, wherein the downstream end of said outer shell is located more downstream than the downstream end of said inner shell.

7. A combustor according to claim 2, wherein the number of said premixing type combustion burners having said resistor provided in the vicinity of the outlet is one or more, and said combustor further includes a diffusion combustion burner.

8. A combustor according to claim 7, wherein a plurality of said premixing type combustion burners each having said resistor provided in the vicinity of the outlet are provided on the same circumference, and said diffusion burner is provided substantially at the center of said circumference.

9. A combustor according to claim 2, further comprising a combustion air nozzle for ejecting combustion air from the periphery of the outlet of said premixing type combustion burner.

10. A gas turbine apparatus comprising:

a combustor including a premixing type combustion burner which has an atomizer for ejecting a liquid fuel together with combustion air to atomize the liquid fuel and an evaporation chamber in which the atomized fuel is evaporated and premixed with the combustion air to form a premixture, wherein said atomizer is comprised of an inner shell, to an inner peripheral surface of which said liquid fuel is supplied, an outer shell defining a passage in which the combustion air can flow substantially straightly between the outer shell and an outer peripheral surface of said inner shell, and a swirling-flow guide plate for swirling combustion air passed into the inner shell, while directing the combustion air in the inner shell in a downstream direction, and said combustor further includes a resistor abruptly increasing in width in a downstream direction and provided substantially downstream of the center of the swirling flow and in the vicinity of an outlet of said premixing type combustion burner for providing a resistance to a premixture ejected from said premixing type combustion burner and a circulating flow of combustion gas produced by combustion of said premixture downstream of said resistor; and a gas turbine adapted to be driven by an exhaust gas discharged from said combustor.

11. A combustion process for burning a fuel-air premixture after previous mixing of a liquid fuel with combustion air and ejecting said premixture from an outlet of a burner, comprising the steps of:

forming, at a location upstream from the outlet of the burner, a swirling flow of said combustion air, which flow swirls while running in a downstream direction;

forming a flow of said combustion air around said swirling flow, which flow runs straightly in the downstream direction;

supplying said liquid fuel to a boundary between said swirling flow and said straightly running flow to premix said liquid fuel with said combustion air; and ejecting a mixture resulting from the premixing of said liquid fuel with said swirling and straightly running combustion air flows from the burner outlet to burn said mixture;

and circulating a combustion gas produced from such combustion in the vicinity of said burner outlet substantially downstream of the center of swirling of said swirling flow.

12. A combustion process according to claim 11, further comprising the step of heating said liquid fuel to a temperature range not exceeding the boiling point, in an atomized atmosphere, of that one of the components of said liquid fuel, which has the lowest boiling point.

13. A combustion process according to claim 11, wherein said liquid fuel, before being supplied to said premixing type combustion burner, is heated to a temperature range represented by the following expression:

$$T^\circ\ C. \geqq \text{temperature}^\circ C.\ \text{of liquid fuel} \geqq T \times 0.8^\circ\ C.$$

wherein T represents the boiling point, in the atomized atmosphere, of that one of the components of said liquid fuel, which has the lowest boiling point.

* * * * *